US011376610B2

(12) United States Patent
Lin et al.

(10) Patent No.: US 11,376,610 B2
(45) Date of Patent: Jul. 5, 2022

(54) WATER OUTLET SWITCHING MECHANISM AND AN OPERATING MECHANISM FOR WATER OUTLET SWITCHING

(71) Applicant: Xiamen Solex High-Tech Industries Co., Ltd., Xiamen (CN)

(72) Inventors: Fengde Lin, Xiamen (CN); Wenxing Chen, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 250 days.

(21) Appl. No.: 16/512,755

(22) Filed: Jul. 16, 2019

(65) Prior Publication Data

US 2020/0188941 A1 Jun. 18, 2020

(30) Foreign Application Priority Data

Dec. 12, 2018 (CN) ..... 201811518960.1

(51) Int. Cl.
*B05B 1/18* (2006.01)
*B05B 1/16* (2006.01)

(52) U.S. Cl.
CPC . *B05B 1/18* (2013.01); *B05B 1/16* (2013.01)

(58) Field of Classification Search
CPC B05B 1/18; B05B 1/16; B05B 1/1636; B05B 12/04
See application file for complete search history.

(56) References Cited

U.S. PATENT DOCUMENTS 7,992,807 B2 * 8/2011 Pan ..... B05B 1/18 239/447
2013/0239320 A1 * 9/2013 Aihara ..... B05B 1/169 4/615

* cited by examiner

*Primary Examiner* — Qingzhang Zhou
(74) *Attorney, Agent, or Firm* — Cooper Legal Group, LLC

(57) ABSTRACT

Disclosed is a water outlet switching mechanism and an operating mechanism for water outlet switching, wherein a sealing member is disposed on a water dividing member and spaced in a moving direction of a activating member at intervals. The sealing member is provided with sealing units corresponding to water dividing holes of the water dividing member. The activating member is provided with a transmission mechanism which is coupled with the sealing units. The transmission mechanism comprises a first transmission member and a second transmission member. The sealing units are divided into first sealing units and second sealing units, wherein the first sealing units are respectively provided with a first transmission fitting member which is used to open a corresponding water dividing hole. The second sealing units are respectively provided with a second transmission fitting member which is used to open a corresponding water dividing hole.

17 Claims, 11 Drawing Sheets

WATER OUTLET SWITCHING MECHANISM AND AN OPERATING MECHANISM FOR WATER OUTLET SWITCHING

RELATED APPLICATION

This application claims priority to Chinese Patent Application 201811518960.1, filed on Dec. 12, 2018, which is incorporated herein by reference.

FIELD OF THE INVENTION

The present invention relates to the field of bathroom fixtures, particularly, the present invention relates to a water outlet switching mechanism.

BACKGROUND OF THE INVENTION

With respect to top shower heads or rain shower heads with a ball head on the market, there are several ways to switch the outlet water types:

1. Conventional rotatable faceplate switching: it requires two hands of the user to operate.

2. Button switching: If the switching position is in the center of the ball head, the arms of the user easily get wet when switching; if the switching position is far from the ball head, as the force position is parallel to the axis of the ball head, the faceplate easily swings when switching.

3. Back-toggle switching: The back toggle cannot be reset: as the force position is perpendicular to the axis of the ball head, it is not easy to make a swing at the faceplate assembly. However, when the toggle has been switched to one of the two extreme positions, as the user cannot see the toggle position, the reapplied force towards one of the two extreme positions tends to loosen the thread of the ball head.

In the aforementioned methods of water dividing, at least one rotatable plate is used to divide water, and the water types can be combined to achieve several single-function types or several mixed-function types. With respect to some special water types which are not adaptable for mixed-function, the mixed-function types will not be achieved. There are limitations in combinations of the water types, and the adaptability is not good. Therefore, people attempt specific designs according to the specific water types of different shower heads.

SUMMARY OF THE INVENTION

In order to solve aforementioned technical problem, the present invention provides a water outlet switching mechanism to achieve switching of single-function or mixed-function of the water types, which is adaptable in operation without using a check valve.

In order to solve the aforementioned technical problem, the present invention provides a water outlet switching mechanism, which is characterized in that: the switching mechanism comprises an operating member, an activating member, a sealing member and a water dividing member.

The sealing member is disposed on the water dividing member, and spaced in a moving direction of the activating member at intervals. The sealing member is provided with sealing units corresponding to water dividing holes of the water dividing member. The activating member is coupled to the operating member, and the activating member is provided with a transmission mechanism which is coupled with the sealing units.

The transmission mechanism comprises a first transmission member and a second transmission member.

The sealing units are divided into first sealing units and second sealing units, wherein the first sealing units are respectively provided with a first transmission fitting member, which is used to open a corresponding water dividing hole by abutting against the first transmission member. The second sealing units are respectively provided with a second transmission fitting member, which is used to open a corresponding water dividing hole by abutting against the second transmission member.

In a preferred embodiment, the activating member is driven to move by the operating member, which causes a relative movement between the transmission mechanism and the sealing member. When the first transmission member is moved to be engaged with the first transmission fitting member, the first sealing unit is moved along a transmission direction generated by the transmission mechanism, so that the first sealing unit is separated from the corresponding water dividing hole and the water dividing hole is opened. When the activating member continues to be driven by the operating member, the first transmission member is moved to an abutted state such that the first transmission fitting member is abutted against the first transmission member.

When the second transmission member is moved to be engaged with the second transmission fitting member, the second sealing unit is moved along the transmission direction generated by the transmission mechanism, so that the second sealing unit is separated from the corresponding water dividing hole and the water dividing hole is opened. When the activating member continues to be driven to move by the operating member, the second transmission member and the second transmission fitting member are released from the abutted state.

In another preferred embodiment, during the movement of the activating member, the first transmission member is in an abutted state such that the first transmission member is abutted against at least two of the first transmission fitting members for at least one moment.

In another preferred embodiment, when the first transmission member is moved to be engaged with two of the first sealing units, the two first sealing units are moved along the transmission direction generated by the transmission mechanism. Therefore, the two first sealing units are separated from the two corresponding water dividing holes, and the two water dividing holes are simultaneously opened.

In another preferred embodiment, the first transmission member comprises a first inclined surface and a planar surface that is disposed at one end of the first inclined surface and is extended to a certain length along the moving direction of the activating member.

In another preferred embodiment, the second transmission member comprises a second inclined surface. The first inclined surface and the second inclined surface are concentrically arranged, and the second inclined surface is located outside of the first inclined surface. The position of the second inclined surface corresponds to or is separated from the first inclined surface.

In another preferred embodiment, the first transmission fitting member is a first protrusion that is disposed outwardly in a radial direction of an outer sidewall of the first sealing unit, the second transmission fitting member is a second protrusion that is disposed outwardly in a radial direction of an outer sidewall of the second sealing unit, and the length of the first protrusion in the radial direction of the outer sidewall of the first sealing unit is longer than the length of the second protrusion of in the radial direction of the outer sidewall of the second sealing unit.

In another preferred embodiment, the second transmission member comprises a second inclined surface. The first inclined surface and the second inclined surface are concentrically arranged, and the second inclined surface is located outside of the first inclined surface. The plane in which the second inclined surface is located is lower than the plane in which the first inclined surface is located, and the position of the second inclined surface corresponds to or is separated from the first inclined surface.

In another preferred embodiment, the first transmission member comprises two first inclined surfaces which are spaced at intervals.

In another preferred embodiment, the second transmission member comprises a second inclined surface. The first inclined surface and the second inclined surface are concentrically arranged, the second inclined surface is located outside of the first inclined surface, and the second inclined surface is located between the two first inclined surfaces.

In another preferred embodiment, the first transmission fitting member is a first protrusion that is disposed outwardly in a radial direction of an outer sidewall of the first sealing unit, the second transmission fitting member is a second protrusion that is disposed outwardly in a radial direction of an outer sidewall of the second sealing unit, the length of the first protrusion in the radial direction of the outer sidewall of the first sealing unit is longer than the length of the second protrusion in the radial direction of the outer sidewall of the second sealing unit, and the first protrusion has a step. The height of the step is equal to a height difference between the first inclined surface and the second inclined surface.

In another preferred embodiment, each of the sealing units is connected to a corresponding resetting member. When the transmission mechanism is moved to be disengaged from the sealing unit, by the function of the resetting member, the sealing unit is driven to move in the opposite direction of the transmission direction generated by the transmission mechanism, so that the sealing member is abutted against the corresponding water dividing hole and the water dividing hole is closed.

In another preferred embodiment, the water outlet switching mechanism further comprises a fixing base for mounting the sealing units, one side of the fixing base that faces the water dividing member comprises accommodating cavities which are equal in quantity to the sealing units. The sealing units and the resetting members are respectively disposed in the corresponding accommodating cavities, and the two ends of the resetting member are respectively abutted against the sealing unit and a bottom of the accommodating cavity.

In another preferred embodiment, the water outlet switching mechanism further comprises a water outlet body. The water outlet body is provided with mutually independent water outlet chambers, and each water dividing hole is connected to only one of the water outlet chambers.

The present invention provides an operating mechanism for water outlet switching, which comprises: a toggle, a driving wheel, a driven wheel, a rotation preventing mechanism, a resetting mechanism and a tension spring. The sidewall of the driving wheel outwardly extends in a radial direction to form a cam.

The toggle and the cam form a link rod set with a link rod. A distance required for the toggle to incrementally move is inversely proportional to an extension length of the cam. The driving wheel and the driven wheel are unidirectionally coupled in one direction by the resetting mechanism. When the driving wheel is reset by the reset force of the tension spring, the driven wheel and the driving wheel are uncoupled.

The driven wheel is coupled with the water outlet switching mechanism.

In a preferred embodiment, the rotation preventing mechanism is a pawl, the sidewall of the driven wheel is provided with a ratchet, and the resetting mechanism is a spring. When the toggle is reset, the driven wheel is pushed to the top by the driving wheel, which is driven by the toggle, and the spring is compressed. When the teeth of the driving wheel are separated from the teeth of the driven wheel, the driven wheel is reset by the force of the spring.

Compared with the existing technology, the technical solution of the present invention has the following beneficial effects:

The present invention provides a water outlet switching mechanism. When the toggle is pushed forward, the rotation of the driving wheel of the intermittent movement mechanism is driven by the link rod set, the driven wheel is driven to rotate by the driving wheel, the driven wheel and the transmission mechanism are fixed, the transmission mechanism is provided with at least two turns of inclined surface which can operate in cooperation with the sealing unit to open the sealing unit orderly to realize the optional combinations of single water function, mixed water function and water stop function, the tension spring is stretched and energy is stored simultaneously. After releasing the hand, the link rod set is driven by the tension spring, the driving wheel and the toggle are reset by overcoming the force of the spring, and the driven wheel is engaged in the switching position under the function of the stop claw. Thus a function cycle is achieved. Thereby, the switching of the single-function or the mixed-function of the water types is achieved without the check valve, and the adaptability is good.

DETAILED DESCRIPTION OF THE EMBODIMENTS

Figure 1:
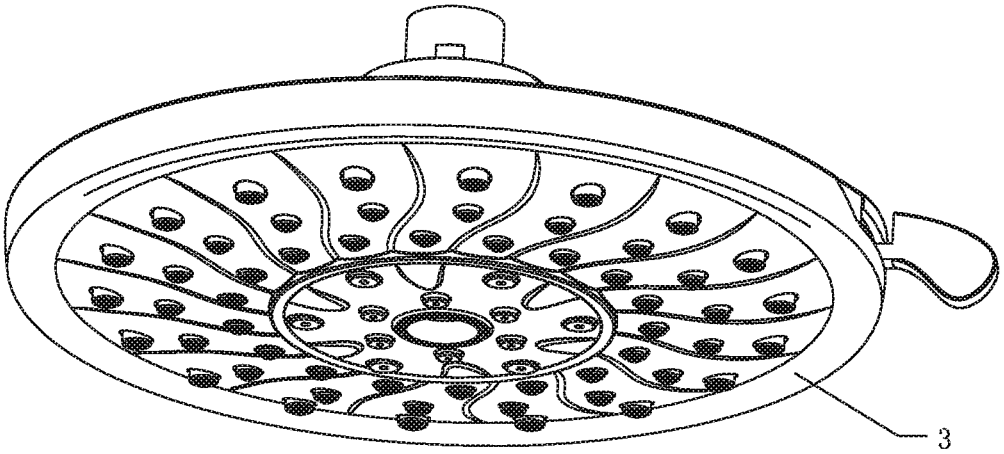
FIG. 1 illustrates a perspective view of the shower head in Embodiment 1 of the present invention.
Figure 2:
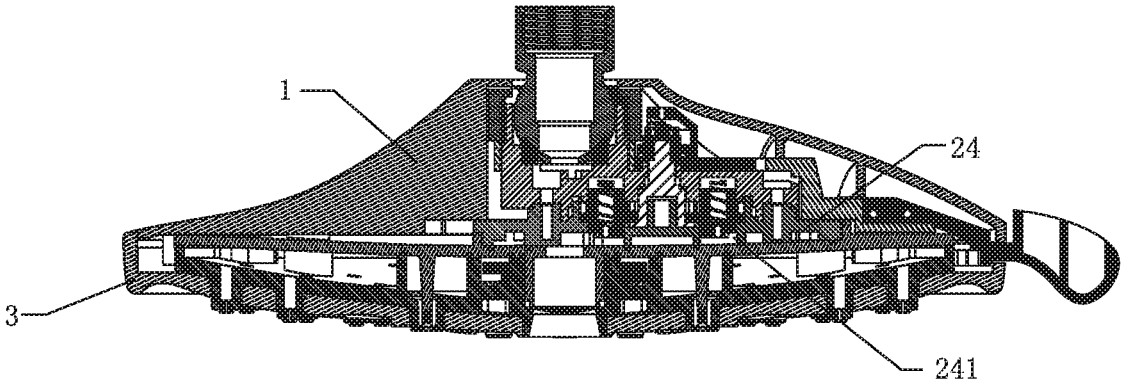
FIG. 2 illustrates a cross-section view of the shower head in Embodiment 1 of the present invention.
Figure 3:
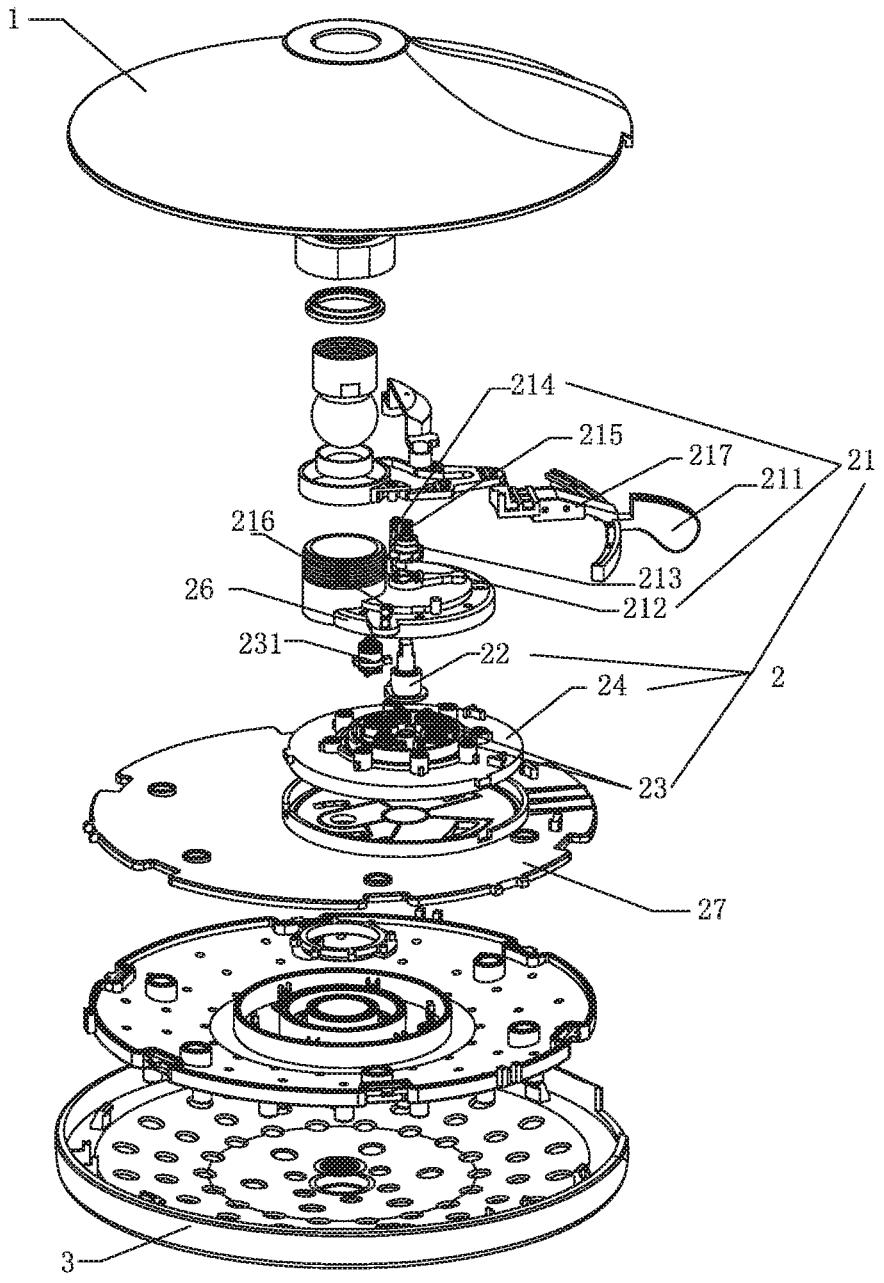
FIG. 3 illustrates an exploded perspective view of the shower head in Embodiment 1 of the present invention.
Figure 4:
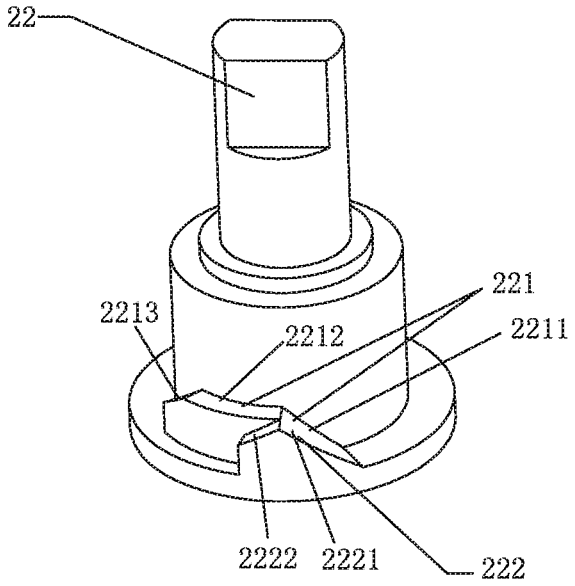
FIG. 4 illustrates a schematic view of the transmission mechanism in Embodiment 1 of the present invention.
Figure 5:
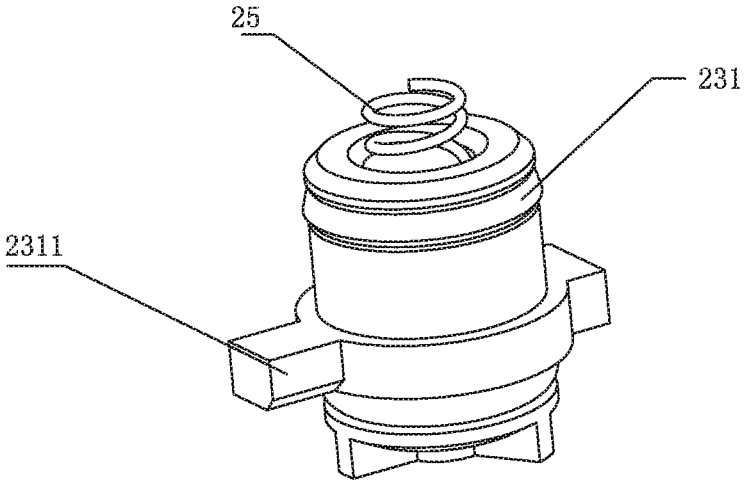
FIG. 5 illustrates a schematic view of the first sealing unit in Embodiment 1 of the present invention.
Figure 6:
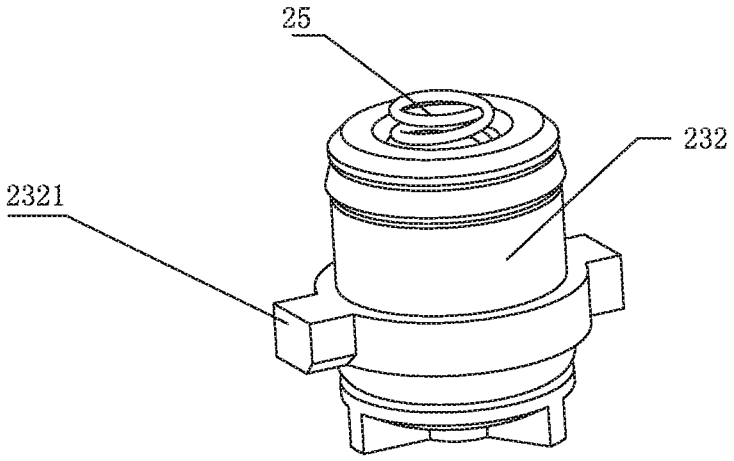
FIG. 6 illustrates a schematic view of the second sealing unit in Embodiment 1 of the present invention.
Figure 7:
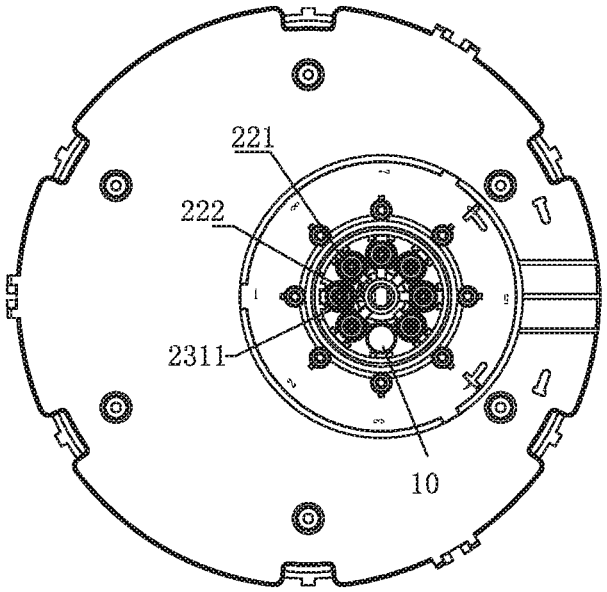
FIG. 7 to FIG. 14 illustrate schematic views showing a switching process in Embodiment 1 of the present invention.
Figure 8:
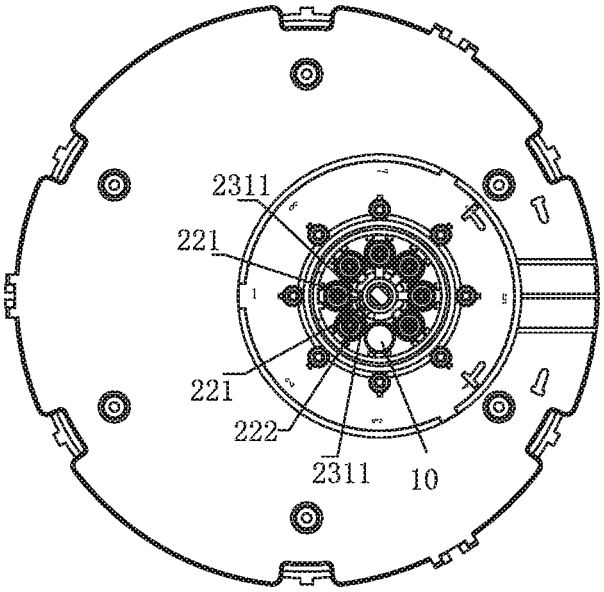
Figure 9:
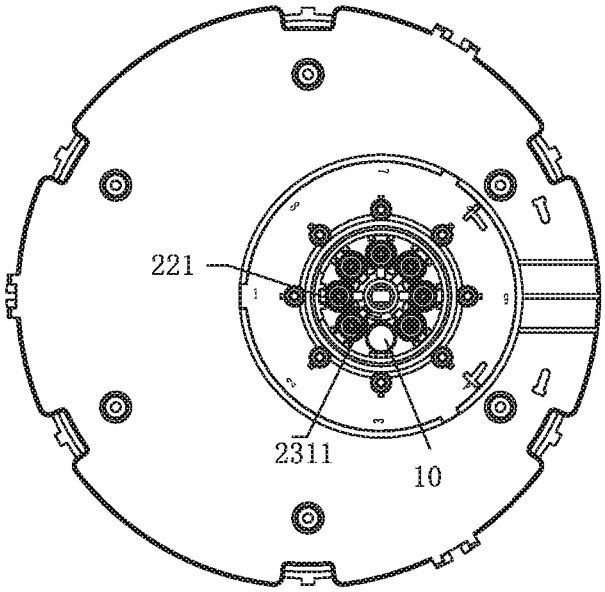
Figure 10:
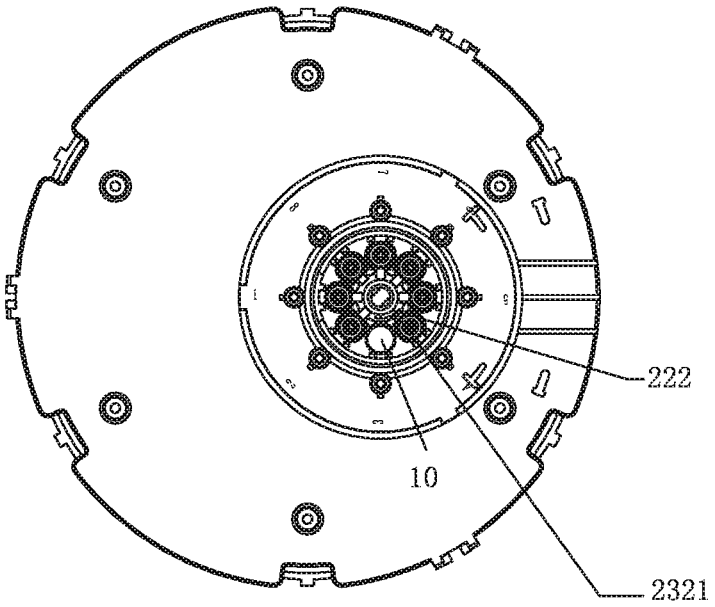
Figure 11:
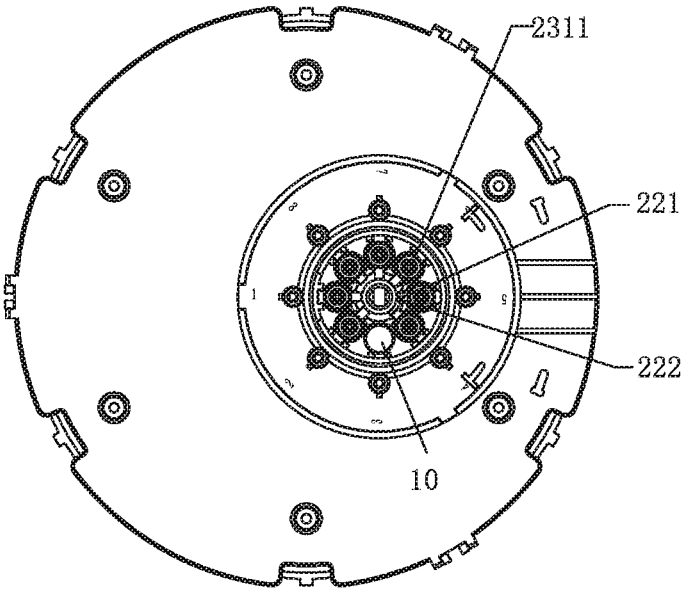
Figure 12:
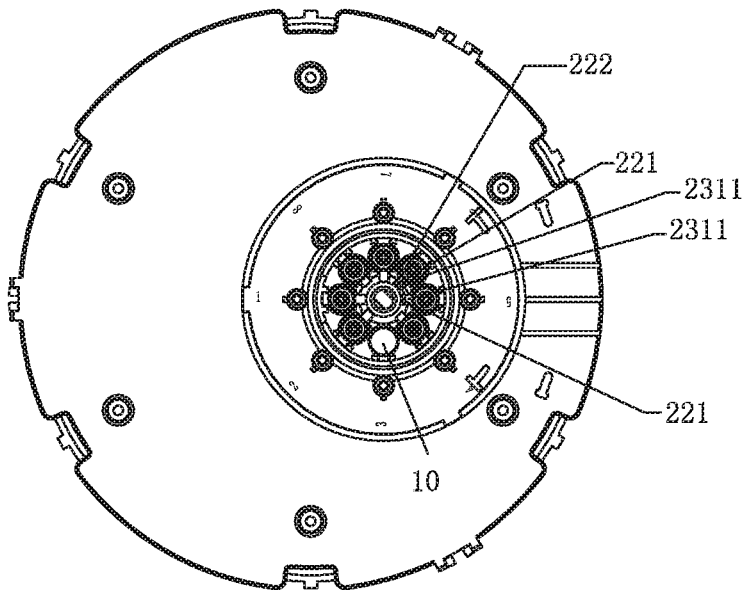
Figure 13:
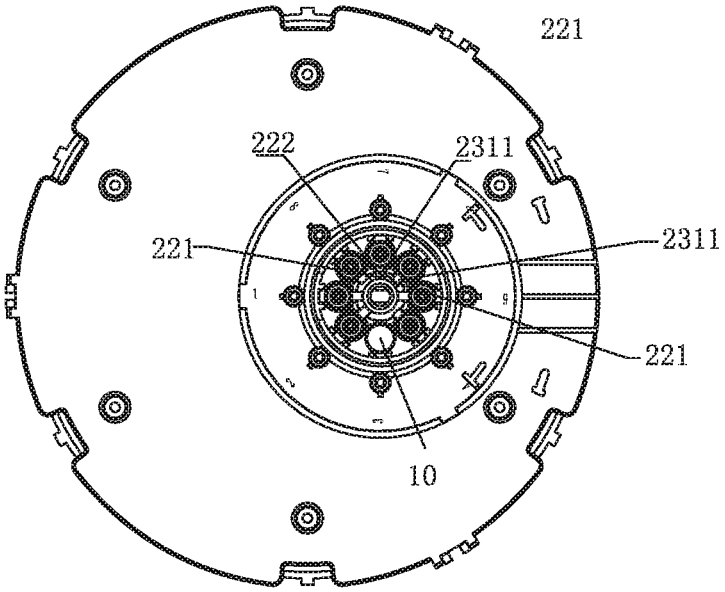
Figure 14:
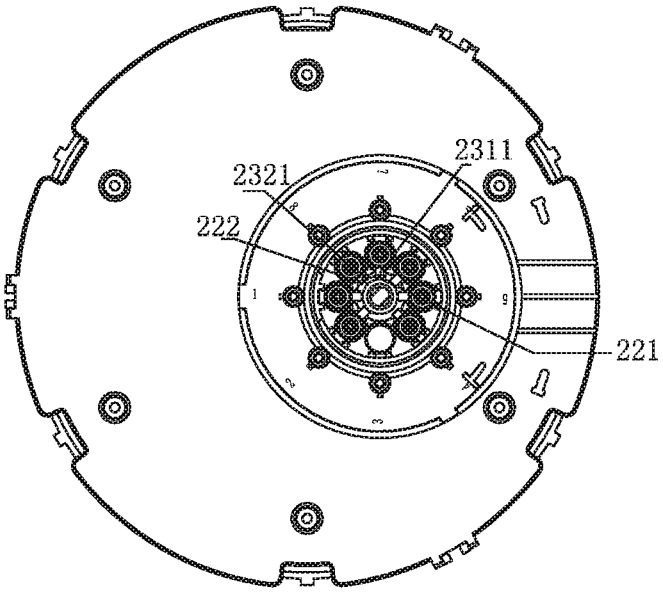

The present invention will be further described below with the combination of the accompanying drawings together with the embodiments.

Embodiment 1

As shown in FIGS. 1-6, the present embodiment provides a shower head comprising a body 1, a water outlet switching mechanism 2 and a water outlet faceplate 3. While, the embodiment illustrates a shower head as an example, it is necessary to note that the water outlet switching mechanism 2 may not be just limited to a shower head but can be installed in any water outlet.

The water outlet switching mechanism 2 comprises: an operating member 21, an activating member 22, a sealing member 23 and a water dividing member 24.

The sealing member 23 is disposed on the water dividing member 24 and spaced in a moving direction of the activating member 22 at intervals. In the present embodiment, the activating member 22 is circumferentially moved, and the sealing member 23 is circumferentially spaced along a circumference of the activating member 22 at intervals. The sealing member 23 is provided with sealing units corresponding to water dividing holes 241 of the water dividing member 24. The activating member 22 is coupled to the operating member 21, and the activating member 22 is provided with a transmission mechanism that operates in cooperation with the sealing units.

The transmission mechanism comprises a first transmission member 221 and a second transmission member 222.

The sealing units are divided into first sealing units 231 and second sealing units 232. The first sealing units 231 are respectively provided with a first transmission fitting member 2311, which is configured to be abutted against the first transmission member 221 so that a corresponding water dividing hole 241 is opened. The second sealing units 232 are respectively provided with a second transmission fitting member 2321, which is configured to be abutted against the second transmission member 222 so that a corresponding water dividing hole 241 is opened.

During the movement of the activating member 22, the first transmission member 221 is pushed against at least two of first transmission fitting members 2311 for at least one moment, and at least two of first sealing units 231 are opened simultaneously, thereby achieving a water mixing effect. In this embodiment, in order for the first transmission member 221 to be pushed against at least two of first transmission fitting members 2311 for at least one moment, the first transmission member 221 extends to a certain length along the moving direction of the activating member 22. In this embodiment, as the activating member 22 is circumferentially moved, the first transmission member 221 extends to a certain length along the circumference of the activating member 22.

Therefore, when the activating member 22 is driven to move by the operating member 21, the transmission mechanism and the sealing member 23 are moved relative to each other. When the first transmission member 221 is moved to be engaged with the first transmission fitting member 2311, the first sealing unit 231 is moved along a transmission direction generated by the transmission mechanism, so that the first sealing unit 231 is separated from the corresponding water dividing hole 241 and the water dividing hole 241 is opened. When the activating member 22 continues to be driven to move by the operating member 21, the first transmission member 221 is moved to an abutted state such that the first transmission fitting member 2311 is abutted against the first transmission member 221 and the first transmission fitting member 2311 is fixed at the current position.

When the second transmission member 222 is moved to be engaged with the second transmission fitting member 2321, the second sealing unit 232 is moved along the transmission direction generated by the transmission mechanism, so that the second sealing unit 232 is separated from the corresponding water dividing hole 241 and the water dividing hole 241 is opened. When the activating member 22 continues to be driven to move by the operating member 21, the second transmission member 222 and the second transmission fitting member 2321 are released from the abutted state.

That is, there is a continuous abutted state between the first transmission member 221 and the first transmission fitting member 2311 and a transient abutted state between the second transmission member 222 and the second transmission fitting member 2321. Then, by adjusting the distance between the two first sealing units 231, two or more first sealing units 231 can be simultaneously abutted against the first transmission member 221. Thereby, the two or more first sealing units 231 are separated from the corresponding water dividing holes 241 and the water dividing holes 241 are simultaneously opened. The second transmission member 222 can be only matched with one of the second sealing units 232. Therefore, when only the single water function is required, the sealing unit corresponding to the water dividing hole 241 is provided as the second sealing unit 232, and when the single water function and the mixed water function are required, the sealing units corresponding to several water dividing holes are provided as the first sealing units 231.

Specifically, in the embodiment, the first transmission member 221 comprises a first inclined surface 2211 and a planar surface 2212 that is disposed at one end of the first inclined surface and is extended to a certain length along the circumferential direction of the water dividing member 24. The second transmission member 222 comprises a second inclined surface 2221. The first inclined surface 2211 and the second inclined surface 2221 are concentrically arranged, and the second inclined surface 2221 is located outside of the first inclined surface 2211.

Furthermore, the end of the planar surface disposed away from the first inclined surface 2211 and the end of the second inclined surface 2221, respectively, have an end inclined surface 2213, 2222. The sealing unit falls slowly along the end inclined surface to reduce the noise generated by an instant fall.

The first transmission fitting member 2311 is a first protrusion that is disposed outwardly in a radial direction of the outer sidewall of the first sealing unit 231. The second transmission fitting member 2321 is a second protrusion that is disposed outwardly in a radial direction of the outer wall of the second sealing unit 232. The length of the first protrusion in the radial direction of the outer sidewall of the first sealing unit is longer than the length of the second protrusion in the radial direction of the outer sidewall of the second sealing unit.

After the transmission mechanism and the sealing unit are disengaged, the sealing unit should be reset and the water dividing hole reclosed. Therefore, each of the sealing units is connected to a corresponding resetting member 25. When the transmission mechanism is moved to be disengaged from the sealing unit, each of the resetting members 25 drives the corresponding sealing unit to move in an opposite direction of the transmission direction generated by the transmission mechanism, so that the sealing unit is abutted against the corresponding water dividing hole 241 and the water dividing hole 241 is closed.

In the embodiment, the water outlet switching mechanism 2 further comprises a fixing base 26 for mounting the sealing units, and a side of the fixing base 26 that faces the water dividing member 24 comprises accommodating cavities which are equal in quantity to the sealing units, and the sealing units and the resetting members 25 are respectively disposed in the corresponding accommodating cavities. The two ends of the resetting member 25 are respectively abutted against the sealing unit and a bottom of the accommodating cavity.

This embodiment further comprises a water outlet body 27 which is provided with mutually independent water outlet chambers. Each of the water dividing holes 241 is connected to only one of the water outlet chambers.

In this embodiment, there are a total of seven accommodating cavities and a blind hole 10. The blind hole 10 is disposed between the second water outlet chamber and the third water outlet chamber. In the accommodating cavities, the first and seventh accommodating cavities are connected to a sheet water outlet chamber, the second accommodating cavity is connected to a splash water outlet chamber, the third, fifth, and sixth accommodating cavities are connected to a shower water outlet chamber, and the fourth accommodating cavity is connected to a massage water outlet chamber. In the sealing units, the third and seventh accommodating cavities correspond to the second sealing units 232, and the other accommodating cavities correspond to the first sealing units 231.

Referring to FIGS. 7-14, the entire switching process is as follows:

1) The first transmission member 221 and the second transmission member 222 of the transmission mechanism are both abutted against the first protrusion of the first sealing unit 231 in the first accommodating chamber. At this time, water flows out from a water passage 1, and the outlet water type is sheet water.

2) The transmission mechanism continues to be rotated, and the first transmission member 221 is respectively abutted against the first protrusions of the first sealing units 231 in the first accommodating cavity and the second accommodating cavity. At this time, water flows out from the water passage 1 and a water passage 2 at the same time, and the outlet water type is sheet water+splash water.

3) The transmission mechanism continues to be rotated. As the blind hole 10 corresponds to a water passage 3 and there is no sealing unit, the first transmission member 221 of the transmission mechanism is abutted against the first protrusion of the first sealing unit 231 in the second accommodating cavity. At this time, water flows out from the water passage 2, and the outlet water type is splash water.

4) The transmission mechanism continues to be rotated. As the third accommodating cavity corresponds to the second sealing unit 232, only the second transmission member 222 is abutted against the second protrusion of the second sealing unit 232. Water flows out from a water passage 4. In this embodiment, the water passage 4 provides a small flow of water outlet. Thus, the water passage 4 can be considered as a position to stop water.

5) The transmission mechanism continues to be rotated, and the first transmission member 221 and the second transmission member 222 of the transmission mechanism are both abutted against the first protrusion of the first sealing unit 231 in the fourth accommodating cavity. At this time water flows out from a water passage 5, and the outlet water type is massage water.

6) The transmission mechanism continues to be rotated, and the first transmission member 221 is abutted against the first protrusions of the first sealing units 231 in the fourth accommodating cavity and the fifth accommodating cavity. At this time, water flows out from the water passage 5 and a water passage 6 simultaneously, and the outlet water type is massage water+shower water.

7) The transmission mechanism continues to be rotated, and the first transmission member 221 is respectively abutted against the first protrusions of the first sealing units 231 in the fifth accommodating cavity and the sixth accommodating cavity. At this time, water flows out from the water passage 6 and a water passage 7 simultaneously, the outlet water type is shower water.

8) The transmission mechanism continues to be rotated, the first transmission member 221 is abutted against the first protrusion of the first sealing unit 231 in the sixth accommodating cavity, and the second transmission member 222 is abutted against the second protrusion of the second sealing unit 232 in the seventh accommodating cavity. At this time, water flows out from the water passage 7 and a water passage 8 simultaneously, and the outlet water type is shower water+sheet water. Therefore, the combinations of water type are sheet water—sheet water+splash water—splash water—small flow of water—massage water—massage water+shower water—shower water—shower water+sheet water, and then the cycle repeats.

Figure 15:
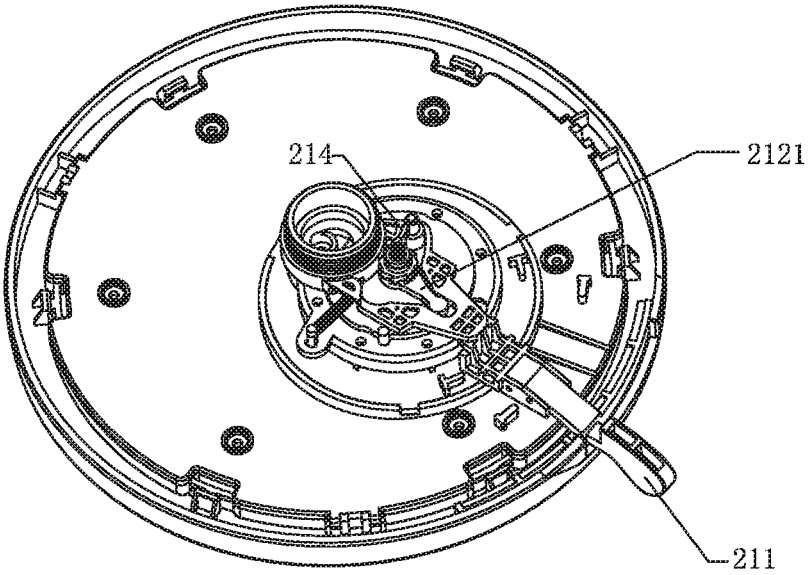
FIG. 15 illustrates a schematic view of the operating member in Embodiment 1 of the present invention.

The operating member 21 comprises a toggle 211, a driving wheel 212, a driven wheel 213, a rotation preventing mechanism 214, a resetting mechanism 215, and a tension spring 216. The sidewall of the driving wheel 212 is outwardly extended in a radial direction to form a cam 2121;

Furthermore, referring to FIG. 15, the toggle 211 is connected to the cam 2121 by a link rod 217 as a link rod set. The distance required for the toggle 211 incrementally move is inversely proportional to the extension length of the cam 2121. The driven wheel 213 is driven to rotate by the toggle 211 through the driving wheel 212. The driving wheel 212 and the driven wheel 213 are unidirectionally coupled in one direction by the resetting mechanism 215. When the driving wheel 212 is reset by the reset force of the tension spring 216, the driven wheel 213 and the driving wheel 212 are uncoupled.

The driven wheel 213 is coupled with the activating member 22.

Specifically, the rotation preventing mechanism 214 is a pawl, the sidewall of the driven wheel 213 is provided with a ratchet, and the resetting mechanism 215 is a spring. When the toggle 211 is toggled to reset the toggle 211, the driven wheel 213 is pushed to the top by the driving wheel 212, which is driven by the toggle 211, and the spring is compressed. When the teeth of the driving wheel 212 are separated from the teeth of the driven wheel 213, the driven wheel 213 is reset by the force of the spring. Each time the toggle is toggled, the transmission mechanism is rotated 45°.

Embodiment 2

Figure 16:
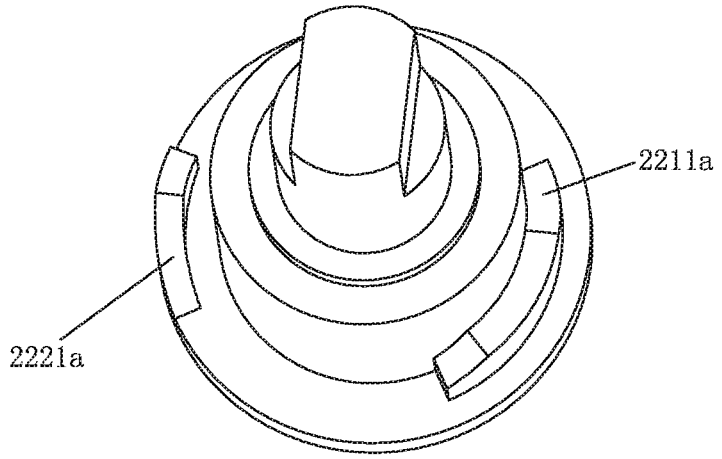
FIG. 16 illustrates a schematic view of the transmission mechanism in Embodiment 2 of the present invention.

Referring to FIG. 16, the difference between this embodiment and Embodiment 1 is as follows: in Embodiment 1, the first inclined surface 2211 and the second inclined surface 2221 are concentrically arranged at the same position. While in this embodiment, the first inclined surface 2211*a* and the second inclined surface 2221*a* are concentrically arranged at the different positions. The rest of the structure is the same as that of the Embodiment 1. The principle and process of the water outlet switching are also the same as those in Embodiment 1 and will not be described again.

Embodiment 3

Figure 17:
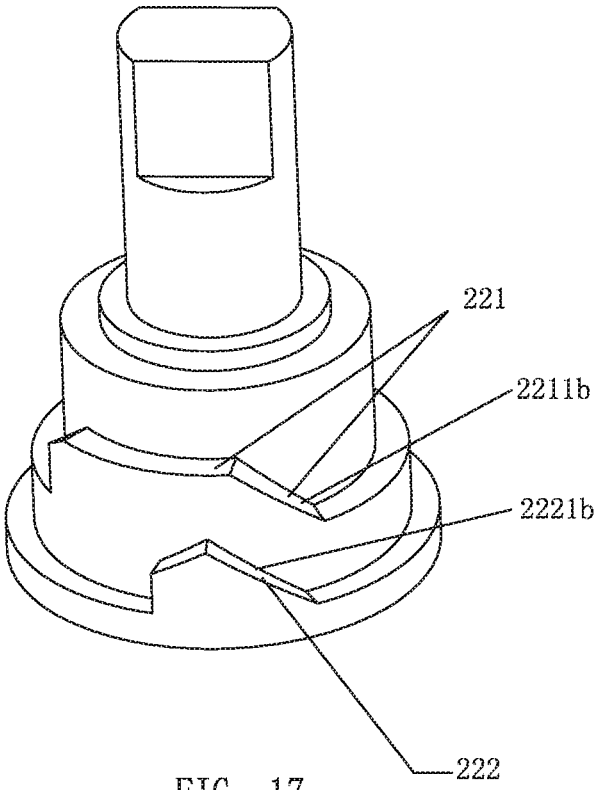
FIG. 17 illustrates a schematic view of the transmission mechanism in Embodiment 3 of the present invention.

Referring to FIG. 17, the difference between this embodiment and the Embodiment 1 is as follows: in the Embodiment 1, the plane where the first inclined surface 2211 is located has the same height as the plane where the second inclined surface 2221 is located. In this embodiment, the plane where the second inclined surface 2221*b* is located is lower than the plane where the first inclined surface 2211*b* is located.

Figure 18:
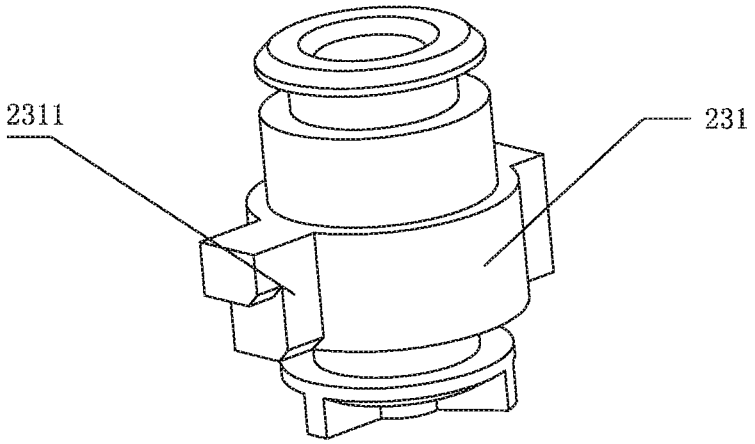
FIG. 18 illustrates a schematic view of the first sealing unit in Embodiment 3 of the present invention.
Figure 19:
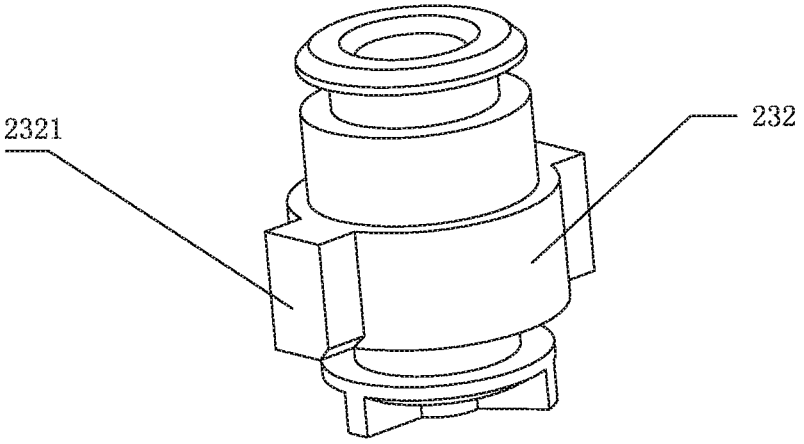
FIG. 19 illustrates a schematic view of the second sealing unit in Embodiment 3 of the present invention.

In order to be adapted to the inclined surface as described above, referring to FIG. 18 and FIG. 19, the first transmission fitting member 2311 is a first protrusion that is disposed outwardly in a radial direction of the outer sidewall of the first sealing unit 231, the second transmission fitting member 2321 is a second protrusion that is disposed outwardly in a radial direction of the outer sidewall of the second sealing unit 232, the length of the first protrusion in the radial direction of the outer sidewall of the first sealing unit 231 is longer than the length of the second protrusion in the radial direction of the outer sidewall of the second sealing unit 232, and the first protrusion comprises a step. The height of the step is equal to a height difference between the first inclined surface and the second inclined surface. The rest of the structure is the same as that of the Embodiment 1. The principle and process of the water outlet switching are also the same as those of the Embodiment 1 and will not be described again.

Embodiment 4

Figure 20:
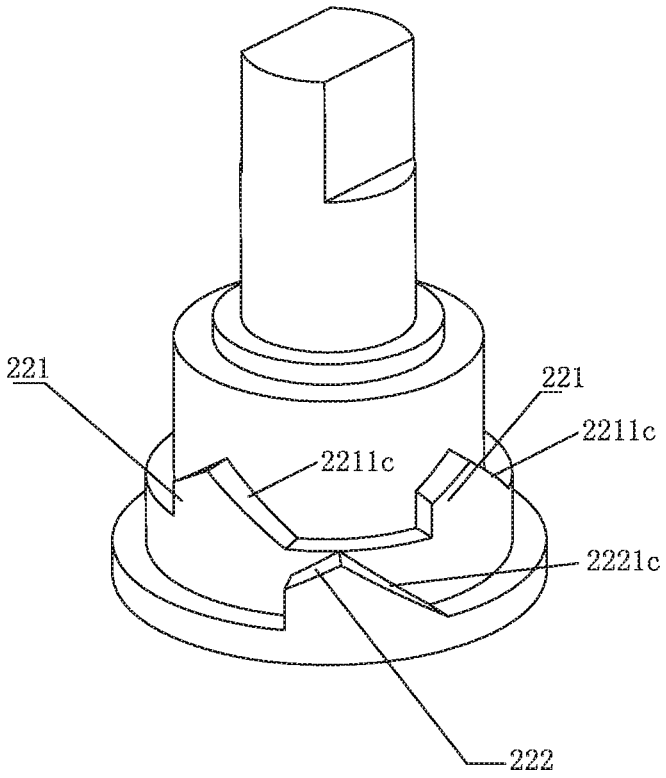
FIG. 20 illustrates a schematic view of the transmission mechanism in Embodiment 4 of the present invention.

Referring to FIG. 20, the difference between this embodiment and the foregoing embodiments is as follows: in the foregoing embodiments, the first transmission member 221 is disposed with a first inclined surface, and a planar surface extending to a certain length at the end of the first inclined surface along the circumferential direction of the water dividing member 24. Therefore, during the movement of the activating member 22, the first transmission member 221 can be abutted against at least two first sealing units 231 for at least one moment.

In the present embodiment, the first transmission member 221 is disposed with two first inclined surfaces 2211*c* at intervals. If it is necessary to open three first sealing units 231 simultaneously, three first inclined surfaces 2211*c* may be provided. Correspondingly, the second transmission member comprises a second inclined surface 2221*c*. The first inclined surface 2211*c* and the second inclined surface 2221*c* are concentrically arranged, the second inclined surface 2221*c* is located outside of the first inclined surface 2211*c*, and the second inclined surface 2221*c* is located between the two first inclined surfaces 2211*c*. The rest of the structure is the same as that of the Embodiment 3. The principle and process of the water outlet switching are also the same as those of the Embodiment 3, and will not be described again.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A water outlet switching mechanism, comprising:
an operating member;
an activating member;
a sealing member; and
a water dividing member, wherein:
the sealing member is disposed on the water dividing member and spaced in a moving direction of the activating member at intervals,
the sealing member is provided with sealing units corresponding to water dividing holes of the water dividing member,
the activating member is coupled to the operating member,
the activating member is provided with a transmission mechanism which is coupled with the sealing units,
the transmission mechanism comprises a first transmission member and a second transmission member,
the first transmission member and the second transmission member define an integral structure and move synchronously,
the sealing units are divided into one or more first sealing units and one or more second sealing units,
the one or more first sealing units are respectively provided with a first transmission fitting member which is used to open a corresponding water dividing hole of the water dividing holes by abutting against the first transmission member or the second transmission member, and
the one or more second sealing units are respectively provided with a second transmission fitting member which is used to open a corresponding water dividing hole of the water dividing holes merely by abutting against the second transmission member.

2. The water outlet switching mechanism according to claim 1, wherein:
the activating member is driven to move by the operating member, which causes a relative movement between the transmission mechanism and the sealing member,
when the first transmission member is moved to be engaged with the first transmission fitting member, the one or more first sealing units are moved along a transmission direction generated by the transmission mechanism, so that the one or more first sealing units are separated from the corresponding water dividing hole and the corresponding water dividing hole is opened,
when the activating member continues to be driven to move by the operating member, the first transmission member is moved to an abutted state such that the first transmission fitting member is abutted against the first transmission member,
when the second transmission member is moved to be engaged with the second transmission fitting member, the one or more second sealing units are moved along the transmission direction generated by the transmission mechanism, so that the one or more second sealing units are separated from the corresponding water dividing hole and the corresponding water dividing hole is opened, and
when the activating member continues to be driven to move by the operating member, the second transmission member and the second transmission fitting member are released from an abutted state.

3. The water outlet switching mechanism according to claim 1, wherein during movement of the activating member, the first transmission member is in an abutted state such that the first transmission member is abutted against at least two of the first transmission fitting members for at least one moment.

4. The water outlet switching mechanism according to claim 3, wherein when the first transmission member is moved to be engaged with two first sealing units of the one or more first sealing units, the two first sealing units are moved along a transmission direction generated by the transmission mechanism to separate the two first sealing units from two corresponding water dividing holes and the two corresponding water dividing holes are simultaneously opened.

5. The water outlet switching mechanism according to claim 1, wherein the first transmission member comprises a first inclined surface and a planar surface that is disposed at one end of the first inclined surface and is extended to a certain length along the moving direction of the activating member.

6. The water outlet switching mechanism according to claim 5, wherein:

the second transmission member comprises a second inclined surface, the first inclined surface and the second inclined surface are concentrically arranged, the second inclined surface is located outside of the first inclined surface, and a position of the second inclined surface corresponds to or is separated from the first inclined surface.

7. The water outlet switching mechanism according to claim 1, wherein:

the first transmission fitting member is a first protrusion that is disposed outwardly in a radial direction of outer sidewalls of the one or more first sealing units, the second transmission fitting member is a second protrusion that is disposed outwardly in a radial direction of outer sidewalls of the one or more second sealing units, and a length of the first protrusion in the radial direction of the outer sidewalls of the one or more first sealing units is longer than a length of the second protrusion in the radial direction of the outer sidewalls of the one or more second sealing units.

8. The water outlet switching mechanism according to claim 1, wherein:

each of the sealing units is connected to a corresponding resetting member, and when the transmission mechanism is moved to be disengaged from the sealing units, by function of the resetting member, the sealing units are driven to move in an opposite direction of a transmission direction generated by the transmission mechanism, so that the sealing member is abutted against a corresponding water dividing hole and the corresponding water dividing hole is closed.

9. The water outlet switching mechanism according to claim 8, wherein:

the water outlet switching mechanism further comprises a fixing base for mounting the sealing units, one side of the fixing base which faces the water dividing member comprises accommodating cavities which are equal in quantity to the sealing units, the sealing units and the resetting members are respectively disposed in corresponding accommodating cavities, and two ends of the corresponding resetting member are respectively abutted against the sealing units and a bottom of the accommodating cavity.

10. The water outlet switching mechanism according to claim 9, wherein:

the water outlet switching mechanism further comprises a water outlet body, the water outlet body is provided with mutually independent water outlet chambers, and each water dividing hole is connected to only one of the water outlet chambers.

11. The water outlet switching mechanism according to claim 2, wherein during movement of the activating member, the first transmission member is in an abutted state such that the first transmission member is abutted against at least two of the first transmission fitting members at least a moment.

12. The water outlet switching mechanism according to claim 2, wherein the first transmission member comprises a first inclined surface and a planar surface that is disposed at one end of the first inclined surface and is extended to a certain length along the moving direction of the activating member.

13. The water outlet switching mechanism according to claim 4, wherein the first transmission member comprises a first inclined surface and a planar surface that is disposed at one end of the first inclined surface and is extended to a certain length along the moving direction of the activating member.

14. An operating mechanism for water outlet switching, comprising:

a toggle;

a driving wheel;

a driven wheel;

a rotation preventing mechanism;

a resetting mechanism; and a tension spring, wherein:

a sidewall of the driving wheel extends outwardly in a radial direction to form a cam, the toggle and the cam form a link rod set with a link rod, a distance required for the toggle to incrementally move is inversely proportional to an extension length of the cam, the driving wheel and the driven wheel are unidirectionally coupled in one direction by the resetting mechanism, when the driving wheel is reset by a reset force of the tension spring, the driven wheel and the driving wheel are uncoupled, and the driven wheel is coupled with the water outlet switching mechanism of claim 1.

15. The operating mechanism for water outlet switching according to claim 14, wherein:

the rotation preventing mechanism is a pawl, a sidewall of the driven wheel is provided with a ratchet, the resetting mechanism is a spring, when the toggle is reset, the driven wheel is pushed to a top by the driving wheel, which is driven by the toggle, and the spring is compressed, and when teeth of the driving wheel are separated from teeth of the driven wheel, the driven wheel is reset by a force of the spring.

16. A water outlet switching mechanism, comprising:

an operating member;

an activating member;

a sealing member; and a water dividing member, wherein:

the sealing member is disposed on the water dividing member and spaced in a moving direction of the activating member at intervals, the sealing member is provided with sealing units corresponding to water dividing holes of the water dividing member, the activating member is coupled to the operating member, the activating member is provided with a transmission mechanism which is coupled with the sealing units, the transmission mechanism comprises a first transmission member and a second transmission member, the sealing units are divided into one or more first sealing units and one or more second sealing units, the one or more first sealing units are respectively provided with a first transmission fitting member which is used to open a corresponding water dividing hole of the water dividing holes by abutting against the first transmission member, the one or more second sealing units are respectively provided with a second transmission fitting member which is used to open a corresponding water dividing hole of the water dividing holes by abutting against the second transmission member, during movement of the activating member, the first transmission member is in an abutted state such that the first transmission member is abutted against at least two of the first transmission fitting members for at least one moment, and when the first transmission member is moved to be engaged with two first sealing units of the one or more first sealing units, the two first sealing units are moved along a transmission direction generated by the transmission mechanism to separate the two first sealing units from two corresponding water dividing holes and the two corresponding water dividing holes are simultaneously opened.

17. A water outlet switching mechanism, comprising:

an operating member;

an activating member;

a sealing member; and a water dividing member, wherein:

the sealing member is disposed on the water dividing member and spaced in a moving direction of the activating member at intervals, the sealing member is provided with sealing units corresponding to water dividing holes of the water dividing member, the activating member is coupled to the operating member, the activating member is provided with a transmission mechanism which is coupled with the sealing units, the transmission mechanism comprises a first transmission member and a second transmission member, the first transmission member comprises a first inclined surface and a planar surface that is disposed at one end of the first inclined surface and is extended to a certain length along the moving direction of the activating member, the second transmission member comprises a second inclined surface, the first inclined surface and the second inclined surface are concentrically arranged, the second inclined surface is located outside of the first inclined surface, a position of the second inclined surface corresponds to or is separated from the first inclined surface, the sealing units are divided into one or more first sealing units and one or more second sealing units, the one or more first sealing units are respectively provided with a first transmission fitting member which is used to open a corresponding water dividing hole of the water dividing holes by abutting against the first transmission member or the second transmission member, and the one or more second sealing units are respectively provided with a second transmission fitting member which is used to open a corresponding water dividing hole of the water dividing holes merely by abutting against the second transmission member.

* * * * *